US010214925B2

(12) United States Patent
Hartman

(10) Patent No.: US 10,214,925 B2
(45) Date of Patent: Feb. 26, 2019

(54) ADJUSTABLE CONCRETE FORM BRACE AND REINFORCEMENT BAR HANGER

(71) Applicant: Terry S. Hartman, Gig Harbor, WA (US)

(72) Inventor: Terry S. Hartman, Gig Harbor, WA (US)

( * ) Notice: Subject to any disclaimer, the term of this patent is extended or adjusted under 35 U.S.C. 154(b) by 0 days.

(21) Appl. No.: 15/794,308

(22) Filed: Oct. 26, 2017

(65) Prior Publication Data

US 2018/0112423 A1 Apr. 26, 2018

Related U.S. Application Data

(60) Provisional application No. 62/413,248, filed on Oct. 26, 2016.

(51) Int. Cl.

| | |
|---|---|
| ***E04G 21/12*** | (2006.01) |
| ***E04G 21/18*** | (2006.01) |
| *E04G 17/14* | (2006.01) |
| *E04C 5/16* | (2006.01) |

(52) U.S. Cl.

CPC ..... *E04G 21/185* (2013.01); *E04C 5/167* (2013.01); *E04G 17/14* (2013.01)

(58) Field of Classification Search

CPC ..... E04G 21/185; E04G 17/14; E04C 5/167; E04C 5/162; E04C 5/168

See application file for complete search history.

(56) References Cited

U.S. PATENT DOCUMENTS

| | | | | |
|---|---|---|---|---|
| 1,079,829 | A * | 11/1913 | Bennett | E04B 1/4171 52/372 |
| 1,616,977 | A | 2/1927 | Koivu | |
| 4,004,874 | A | 1/1977 | Foster | |
| 4,017,051 | A | 4/1977 | Scott et al. | |
| 4,101,111 | A | 7/1978 | Bishop | |
| 4,190,999 | A | 3/1980 | Hampton | |
| 4,443,981 | A | 4/1984 | Weiss | |
| 4,644,726 | A | 2/1987 | Wheeler | |
| 4,644,727 | A | 2/1987 | Hanson et al. | |
| 4,723,752 | A | 2/1988 | Thomas | |
| 4,796,851 | A | 1/1989 | Brechbuehler | |
| 4,888,931 | A | 12/1989 | Meilleur | |

(Continued)

OTHER PUBLICATIONS

QuadLock ICF: Ties for Insulated Concrete Forms, http://www.quadlock.com/insulatedconcreteforms/ties.htm, accessed on Sep. 1, 2016.

(Continued)

*Primary Examiner* — Patrick J Maestri

(74) *Attorney, Agent, or Firm* — George A. Leone; Citadel Patent Law

(57) ABSTRACT

An adjustable concrete form brace includes a horizontal adaptable extension member. A first lower brace element and a second lower brace element opposing the first lower brace element each have a horizontal insertion channel adapted to receive the horizontal extension member. A first upper brace element and second upper brace element are attached to the first lower brace element and the second lower brace element respectively. Each of the lower brace members include a saddle, and each saddle is adapted to retain one or more reinforcement bars. The first upper brace element and second upper brace element each include a form retaining element.

6 Claims, 14 Drawing Sheets

(56) References Cited

U.S. PATENT DOCUMENTS

| | | | | |
|---|---|---|---|---|
| 5,174,083 | A | 12/1992 | Mussell | |
| 5,388,804 | A | 2/1995 | Cohen et al. | |
| 5,509,636 | A | 4/1996 | Cotugno | |
| 5,688,428 | A | 11/1997 | Maguire | |
| 5,852,907 | A | 12/1998 | Tobin et al. | |
| 5,937,604 | A | 8/1999 | Bowron | |
| 6,021,994 | A | 2/2000 | Shartzer, Jr. | |
| 6,141,937 | A | 11/2000 | Dressler | |
| 6,240,688 | B1 | 6/2001 | Dressler | |
| 6,247,273 | B1 | 6/2001 | Nickel | |
| 6,591,574 | B2 | 7/2003 | Humphrey | |
| 6,883,289 | B2 * | 4/2005 | Juedes | E04C 5/163 404/135 |
| 7,032,357 | B2 | 4/2006 | Cooper et al. | |
| 7,275,731 | B1 | 10/2007 | Shinault | |
| 7,467,777 | B2 | 12/2008 | Huber et al. | |
| 7,775,499 | B2 | 8/2010 | Metcalf | |
| 8,231,100 | B2 | 7/2012 | Boese et al. | |
| 8,348,225 | B2 | 1/2013 | Boese et al. | |
| 8,646,746 | B2 | 2/2014 | Boese et al. | |
| 8,919,726 | B2 | 12/2014 | Hendricks | |
| 9,068,368 | B2 | 6/2015 | Rafferty et al. | |
| 9,371,648 | B1 | 6/2016 | Tikhovskiy | |
| 2002/0092253 | A1 | 7/2002 | Beliveau | |
| 2005/0023432 | A1 * | 2/2005 | Huber | E02D 27/01 249/34 |

OTHER PUBLICATIONS

Accufooting Concrete Footing Brace, http://www.footingbrace.com/, accessed on Sep. 1, 2016.

Rebar Support Chair w/o Base, http://www.paragonproductsia.com/rebarbrsupportsrebarsupportchairbasec294_300len.html, accessed on Sep. 1, 2016.

Rebar Supports Owens Supply, http://owensupply.com/Docs/steel_supports.htm, accessed on Sep. 1, 2016.

* cited by examiner

ADJUSTABLE CONCRETE FORM BRACE AND REINFORCEMENT BAR HANGER

TECHNICAL FIELD

The present invention relates to concrete form braces. More particularly, the invention relates to an adjustable concrete form brace with reinforcement bar hangers.

BACKGROUND

Historically, concrete has been used to form the base or foundation of a building. During construction, channels defining the borders of the base or foundation are prepared. Concrete forms are then set up in the channels where the concrete forms are located adjacent to and connected to each other and arranged to match the dimensions of the required foundation or footing. The forms, which are typically made from steel panels or wooden boards or planks, are put into position on their edges across from each other and parallel to each other near the side walls of the channels.

In order to strengthen the foundation, steel reinforcement is used. Generally, this reinforcement is put into place using reinforcing bars. For best effect, the reinforcing bars are positioned within the concrete forms such that poured concrete will cover all surfaces of the reinforcing bars, top and bottom. For example, a horizontally oriented reinforcing bar is conventionally held in place by using separate reinforcing bar mounting stands. Some of the generally available reinforcing bar stands can be connected to the form after the form has been constructed, while others are positioned in the form and the reinforcing bar is placed on the device. Similarly, vertically oriented reinforcing bars are conventionally secured in the forms by devices that are connected to the form after it is constructed. Placing the reinforcing bar securing devices in the desired location within the form requires a substantial amount of labor and some degree of skill.

In one example as disclosed in U.S. Pat. No. 5,688,428, issued Nov. 18, 1997 to Maguire and entitled "Holder for Vertical Steel Rebar," a member having first and second vertically extending leg portions, and a base member connecting one end of each leg member, a wood beam for the concrete structure being positioned in the channel formed between the first and second leg portions are included. A plurality of cup shaped members is formed along the outside surface of the first leg portion, in one embodiment, and along the outside surface of both leg portions in a second embodiment, vertical steel rebars are positioned in a selected one of the cup shaped members. Holes may be formed in the base member to receive fasteners to secure the member to the underlying wood frame member.

In another example, as disclosed in U.S. Pat. No. 6,247,273, issued Jun. 19, 2001 to Nickel and entitled "Adjustable Form Brace," an adjustable bracing system is configured for supporting poured concrete wall systems and includes a vertical brace for engaging the wall. A slider slides vertically along a channel of the vertical brace. An adjustable length leg member connects at an upper end to the slider and extends outwardly away from the brace and connects at a lower end to a foot member. The leg is rotatably mounted at one end to a threaded member, wherein rotation of the leg in a first direction extends the threaded member and the length of the leg member, and rotation in a second opposite direction retracts the threaded member and shortens the length of the leg member.

In yet another example, as disclosed in U.S. Pat. No. 7,467,772, issued Dec. 23, 2008 to Huber and Hartman (the inventor of the present invention) and entitled "Devices for Securing Reinforcing Bars within Concrete Forms for Concrete," devices for supporting horizontally oriented reinforcing bars in a form for concrete and devices for supporting vertically oriented reinforcing bars are disclosed. The devices for supporting horizontally oriented reinforcing bars engage the side walls of a form, span the space between the walls, and remain securely in position. The device includes guide members for guiding reinforcing bar sections into a desired position, and members that secure the reinforcing bar in position. The devices for supporting vertically oriented reinforcing bars are used with a generally L-shaped section of reinforcing bar and secured to two parallel sections of horizontal reinforcing bar. U.S. Pat. No. 7,467,772 is hereby incorporated herein by reference.

Many other types of concrete form braces have been used and designed. Unfortunately, known devices do not have the ability to adjust to various widths of forms defining footing or foundation borders. There is also a need for an adjustable vertical brace for holding hooked reinforcement bars in position. This has led to a situation wherein a myriad of parts must be kept on hand in order to adapt to various construction situations. Using conventionally available bracing devices, requires manufacturing about 60 different parts ranging in inches from 6×12 to 6×48, 8×12 to 8×48, 10×16 to 10×48, 12×20 to 12×48, etc. in order to service customer demand. Current devices and methods exhibit several drawbacks including higher cost, rust issues, and many require stakes, tie wire, and additional lumber for bracing. Further, due to the myriad of parts needed and complicated installation techniques, commercially available devices are labor intensive.

In a striking improvement over conventionally available concrete form braces, the present invention for the first time provides an adjustable concrete form brace that will adjust to any size in depth and width. In addition, the improved form brace disclosed herein, in one embodiment, can service customer demand for width adjustment by requiring a substantially reduced number of parts. No other commercially available concrete form bracket can adjust to depth and width. It is believed that the adjustable concrete form brace disclosed herein will reduce labor by up to 50%. In addition, the disclosed concrete form brace can be made of durable injection mold plastic that has a limited range of flexibility, will not rust or break and will be able to withstand heavy form pressure as well as the weight of concrete. Further the adjustable concrete form brace disclosed herein is the only product needed to set form spacing to exact specifications, stop spreading, and securely hold rebar at the appropriate height and width. Further still, the adjustable concrete form brace disclosed herein allows for a smoother top finish since after installation there are no hardware/obstacles to impede troweling.

BRIEF SUMMARY OF THE DISCLOSURE

This summary is provided to introduce, in a simplified form, a selection of concepts that are further described below in the Detailed Description. This summary is not intended to identify key features of the claimed subject matter, nor is it intended to be used as an aid in determining the scope of the claimed subject matter.

Disclosed herein is an adjustable concrete form brace that includes a horizontal adaptable extension member. A first lower brace element and a second lower brace element opposing the first lower brace element each have a horizontal insertion channel adapted to receive the horizontal extension member. A first upper brace element and second upper brace element are attached to the first lower brace element and the second lower brace element respectively. Each of the lower brace members include a saddle, and each saddle is adapted to retain one or more reinforcement bars. The first upper brace element and second upper brace element each include a form retaining element.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

Figure 1:
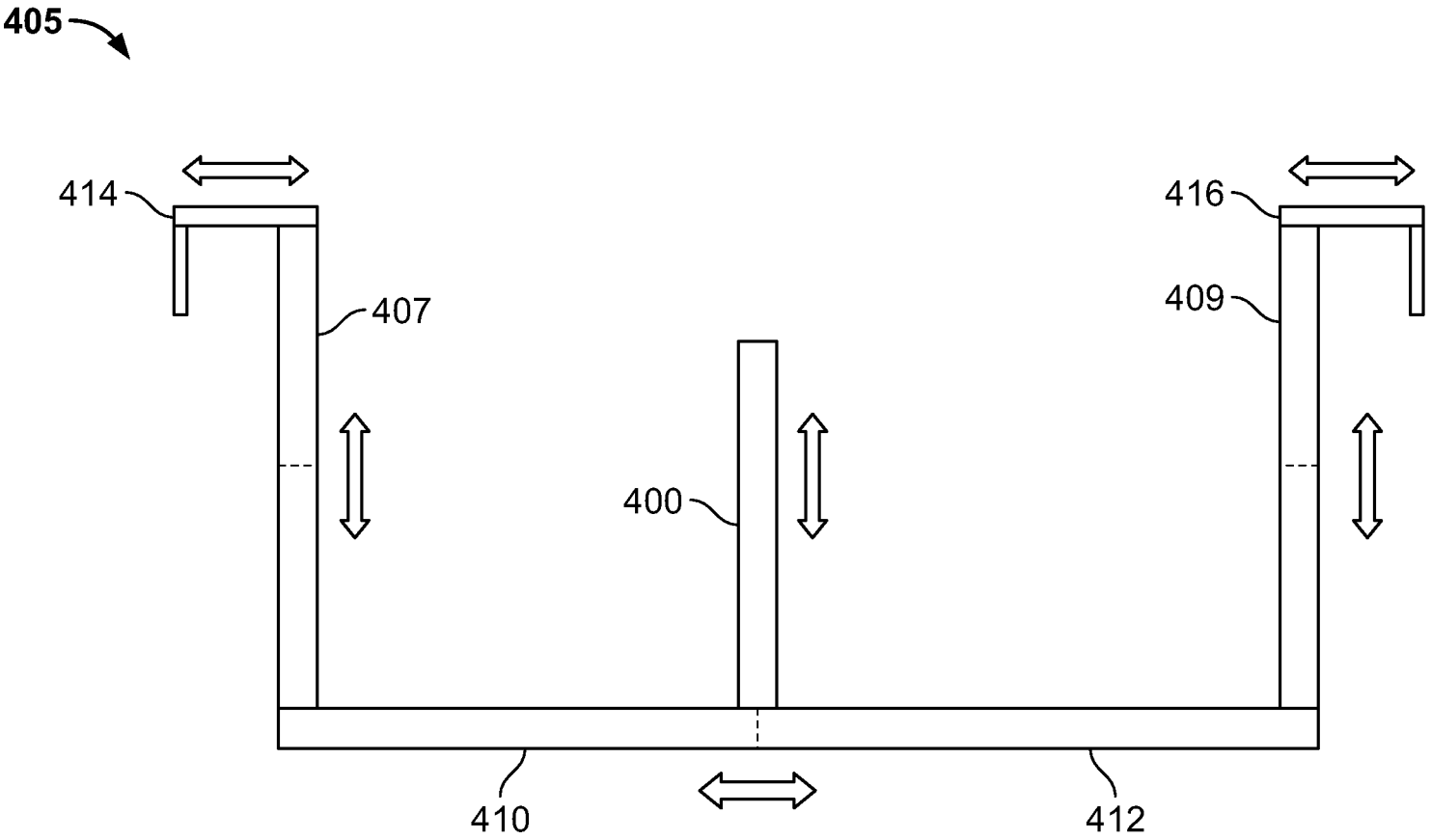
FIG. 1 schematically shows a highly conceptualize view of an adjustable concrete form brace with an adjustable vertical reinforcement bar support after installation but prior to the addition of concrete.

In the drawings, identical reference numbers call out similar elements or components. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not necessarily intended to convey any information regarding the actual shape of the particular elements, and have been solely selected for ease of recognition in the drawings.

DETAILED DESCRIPTION OF THE PREFERRED EMBODIMENTS

The following disclosure describes an adjustable concrete form brace. Several features of methods and systems in accordance with example embodiments are set forth and described in the figures. It will be appreciated that methods and systems in accordance with other example embodiments can include additional procedures or features different than those shown in the figures. Example embodiments are described herein with respect to an adjustable concrete form brace for use in pouring concrete footings. However, it will be understood that these examples are for the purpose of illustrating the principles, and that the invention is not so limited.

Definitions

Generally, as used herein, the following terms have the following meanings, unless the use in context dictates otherwise:

The use of the word "a" or "an" when used in conjunction with the term "comprising" in the claims or the specification means one or more than one, unless the context dictates otherwise. The term "about" means the stated value plus or minus the margin of error of measurement or plus or minus 10% if no method of measurement is indicated. The use of the term "or" in the claims is used to mean "and/or" unless explicitly indicated to refer to alternatives only or if the alternatives are mutually exclusive. The terms "comprise", "have", "include" and "contain" (and their variants) are open-ended linking verbs and allow the addition of other elements when used in a claim.

Reference throughout this specification to "one example" or "an example embodiment," "one embodiment," "an embodiment" or combinations and/or variations of these terms means that a particular feature, structure or characteristic described in connection with the embodiment is included in at least one embodiment of the present disclosure. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Detailed Description of the Figures

Figure 1A:
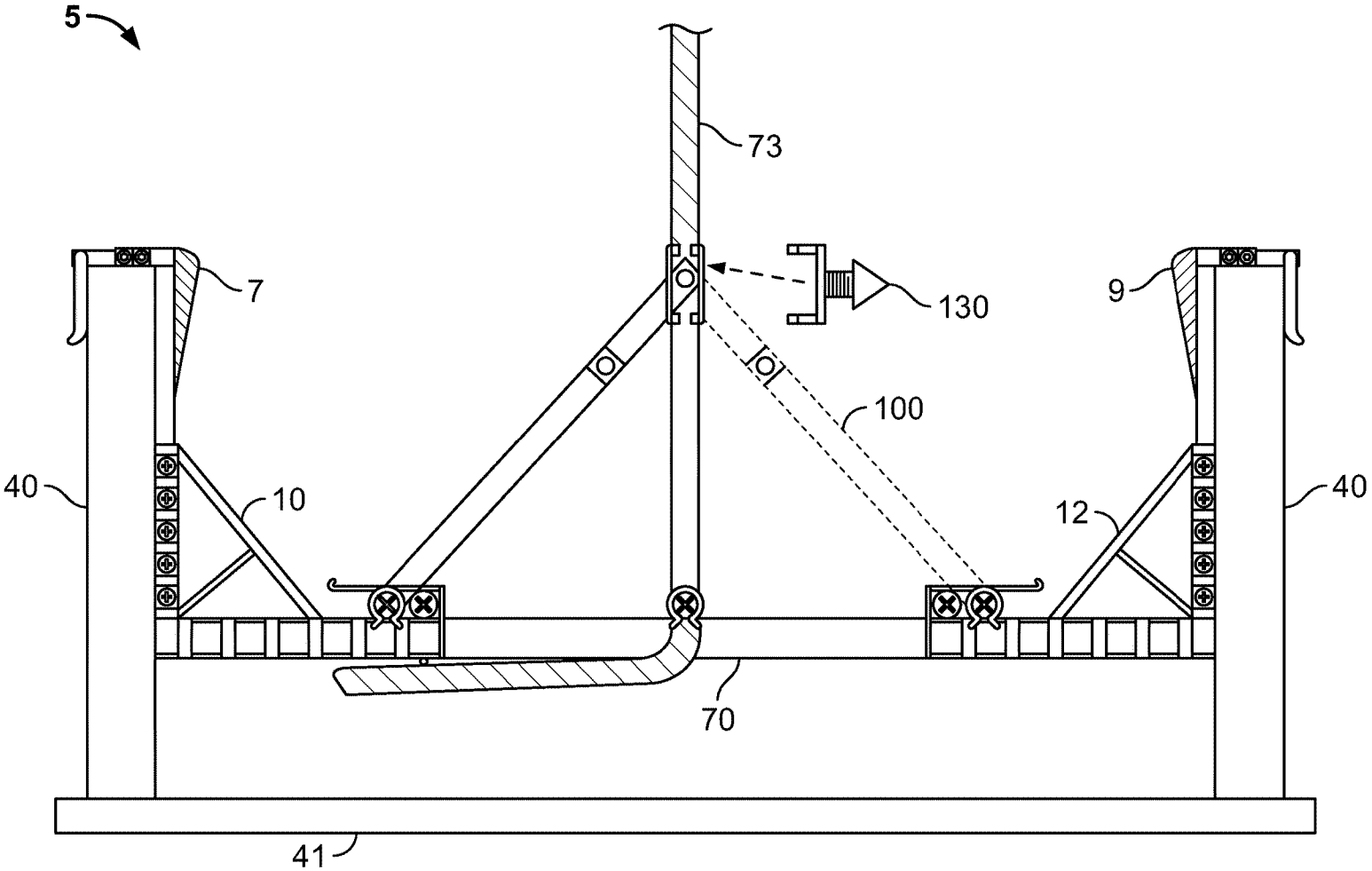
FIG. 1A schematically shows a more detailed overall conceptual view of an adjustable concrete form brace with an adjustable vertical reinforcement bar support after installation but prior to the addition of concrete.

Referring now to FIG. 1, a highly conceptualized view of an adjustable concrete form brace with an adjustable vertical reinforcement bar support after installation but prior to the addition of concrete is schematically shown. An adjustable concrete form brace 405 includes a first lower brace element 410 and a second lower brace element 412. A first upper brace element 407 and a second upper brace element 409 are configured to be affixed to or inserted into the first and second lower brace elements respectively. The first and second upper brace elements 407, 409, each comprise a fixed or horizontally adjustable horizontal upper element 414, 416 respectively. The horizontal upper elements 414, 416 are configured to engage with opposing forms when installed on a soil surface, usually in channels or the like (as shown in FIG. 1A). A fixed or adjustable vertical brace 400 is sized to slip over a standard reinforcement bar. The elements are intended to be configured such that at least one of the elements is adjustable for a particular configuration. Note that, as indicated by the plurality of double-headed arrows, one or more sets of these components may be fixed or adjustable in various configurations. For example, the upper brace elements may be vertically adjustable as by sliding into a channel of one of the lower brace elements. As another example, the lower brace elements may be horizontally adjustable for differing widths. As another example, the vertical brace 400 may be vertically adjustable for differing heights. These components and associated elements are described in detail below with reference to the figures.

Referring now to FIG. 1A, a more detailed overall conceptual view of an adjustable concrete form brace with an adjustable vertical reinforcement bar support after installation but prior to the addition of concrete is schematically shown. An adjustable concrete form brace 5 includes a first lower brace element 10 and a second lower brace element 12. A first upper brace element 7 and a second upper brace element 9 are configured to be inserted into the first and second lower brace elements respectively. The upper brace elements 7, 9 are configured to engage with opposing forms 40. The opposing forms 40, in turn, are installed on a soil surface 41, usually in channels or the like. An extension member 70 protrudes lengthwise in line with the lower brace to provide added length when needed. An adjustable vertical brace 100 is sized to slip over a standard reinforcement bar 73. A locking mechanism such as a snap tab 130 is used to lock the adjustable vertical brace at a selected position on the reinforcement bar 73. These components and associated elements are described in detail below with reference to the figures. Note that, when installed, the adjustable concrete form brace will allow concrete to be poured over, under and through the brace up to the limits of the forms' dimensions or as desired by a contractor for a specific application.

Figure 2A:
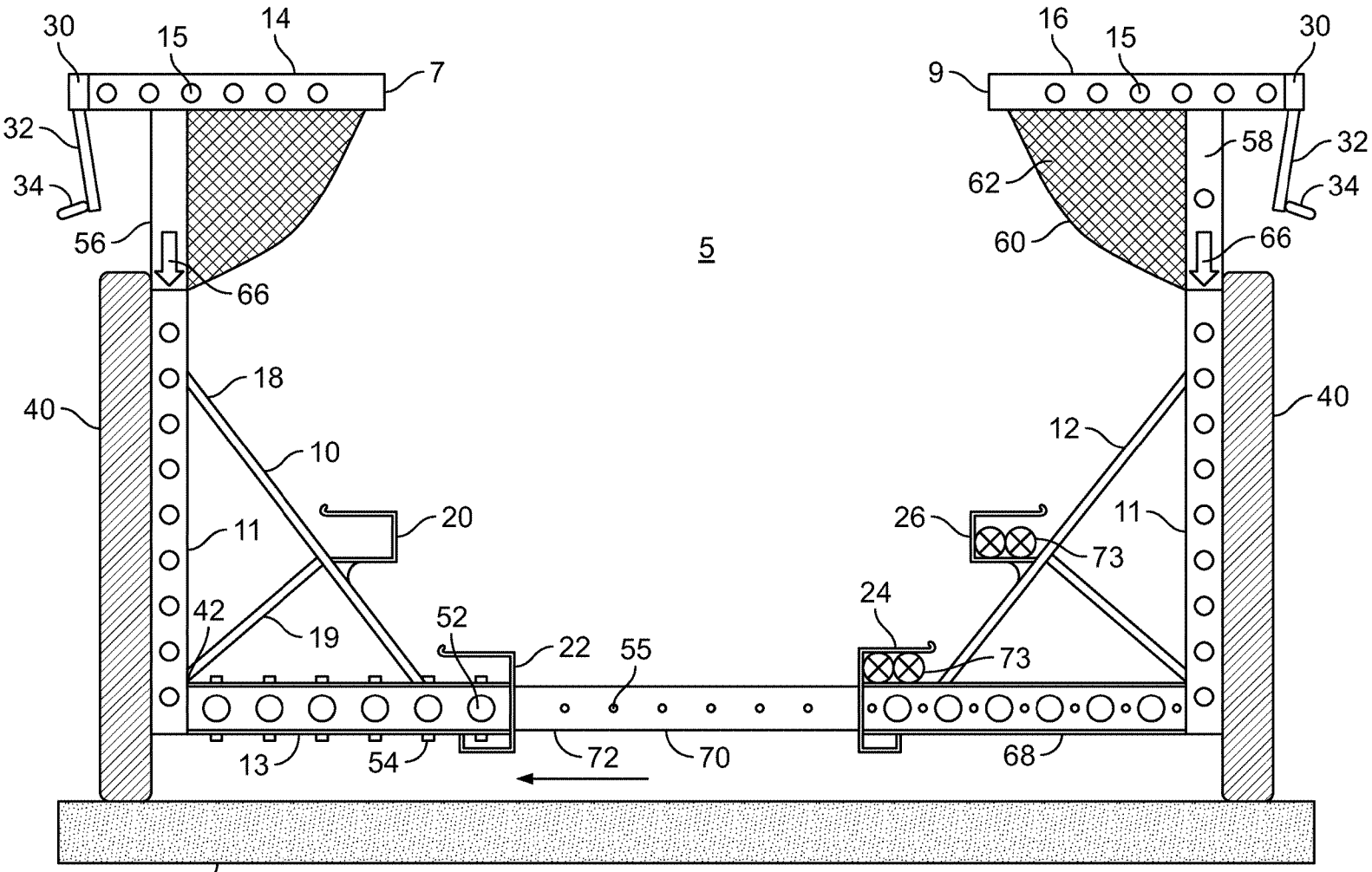
FIG. 2A schematically shows an overall conceptual view of an adjustable concrete form brace prior to insertion of the top brace element into the lower brace element.

Referring now to FIG. 2A, an overall conceptual side view of an adjustable concrete form brace prior to full insertion of the top brace element into the lower brace element is schematically shown. An adjustable concrete form brace 5 includes a first lower brace element 10 and a second lower brace element 12. A first upper brace element 7 and a second upper brace element 9 are configured to be inserted into the first and second lower brace elements respectively. The first lower brace element 10 includes a vertical element 11 and a horizontal element 13 attached at a corner to form a right angle 42. A first support 18 is attached between an upper portion of the vertical element 11 and a predetermined location on horizontal element 13 opposite the right angle 42. A second support 19 substantially bifurcates the right angle 42 and is attached between the right angle 42 and an area located generally below the midpoint of support 18. Apertures 52 are generally uniformly located on the vertical element 11 and on the horizontal element 13 for the purposes of allowing cement to penetrate through and around the brace 5. In one useful example, detent areas 54 are located along the top and bottom surfaces of horizontal element 13 for receiving snap tabs in order to lock the brace 5 into various horizontal lengths as required by a particular application or job.

Each of the lower brace members 10, 12 may advantageously include saddles 20, 22, 24, 26 in which reinforcement bars 73 may be constrained or retained. The saddles 20, 22, 24, 26 may be extruded as part of the process of manufacturing the various parts, or may be attached separately using conventional techniques. The saddles 20, 22, 24, 26 may advantageously be made to accommodate at least two reinforcement bars laying lengthwise inside of the saddles. This allows reinforcement bars to overlap at the ends as required by most building codes.

The second lower brace element 12 is constructed substantially similarly to the first lower brace element 10 with a few differences. In a departure from the construction of the first lower brace element 10, the second lower brace element includes a horizontal lower brace element 68. Depending on the locking scheme used, one of the brace elements may not require detents. For example, an affixed extension member 70 may be constructed to protrude lengthwise in line with the horizontal lower brace element 68 to provide added length. The extension member 70 advantageously includes locking snap tabs 72 adapted to mate with the detents 54. In operation, the extension member 70 allows the combination of the first and second brace members to be adjusted in width as needed. Extension member 70 may include screw holes 55 which are used as needed when installing. Other members may also include screw holes although not all are shown here in order to simplify the drawings to promote understanding of the general concepts of the disclosed example.

The first and second upper brace elements 7, 9, each comprise a horizontal upper element 14, 16 respectively having apertures 15 for concrete flow through purposes. The horizontal elements 14, 16 are each attached to an upper vertical element 56, 58 respectively. The upper vertical elements 56, 58 may advantageously be attached perpendicularly to the upper horizontal elements. Inserted into each upper horizontal element 14, 16 is a form retaining element 30. The form retaining element 30 includes a downward protruding elongated attachment member 32 having a lip 34. A web 62 is attached between each upper horizontal element 14, 16 and each upper vertical element 56, 58. The web 62 is bounded and further supported by an arcuate support 60 attached between the upper horizontal and vertical elements for added strength. As indicated by downward arrows 66 (showing direction only and not part of the device), the upper brace elements have an outside perimeter sufficiently small to be inserted into a channel inside of the vertical lower brace element 11. A similar channel is in the vertical lower brace element 11 for lower brace 12. When lowered, the attachment members 32 will engage forms 40, where the forms 40 are typically boards or steel plates delineating the borders of a foundation or footings.

Figure 2B:
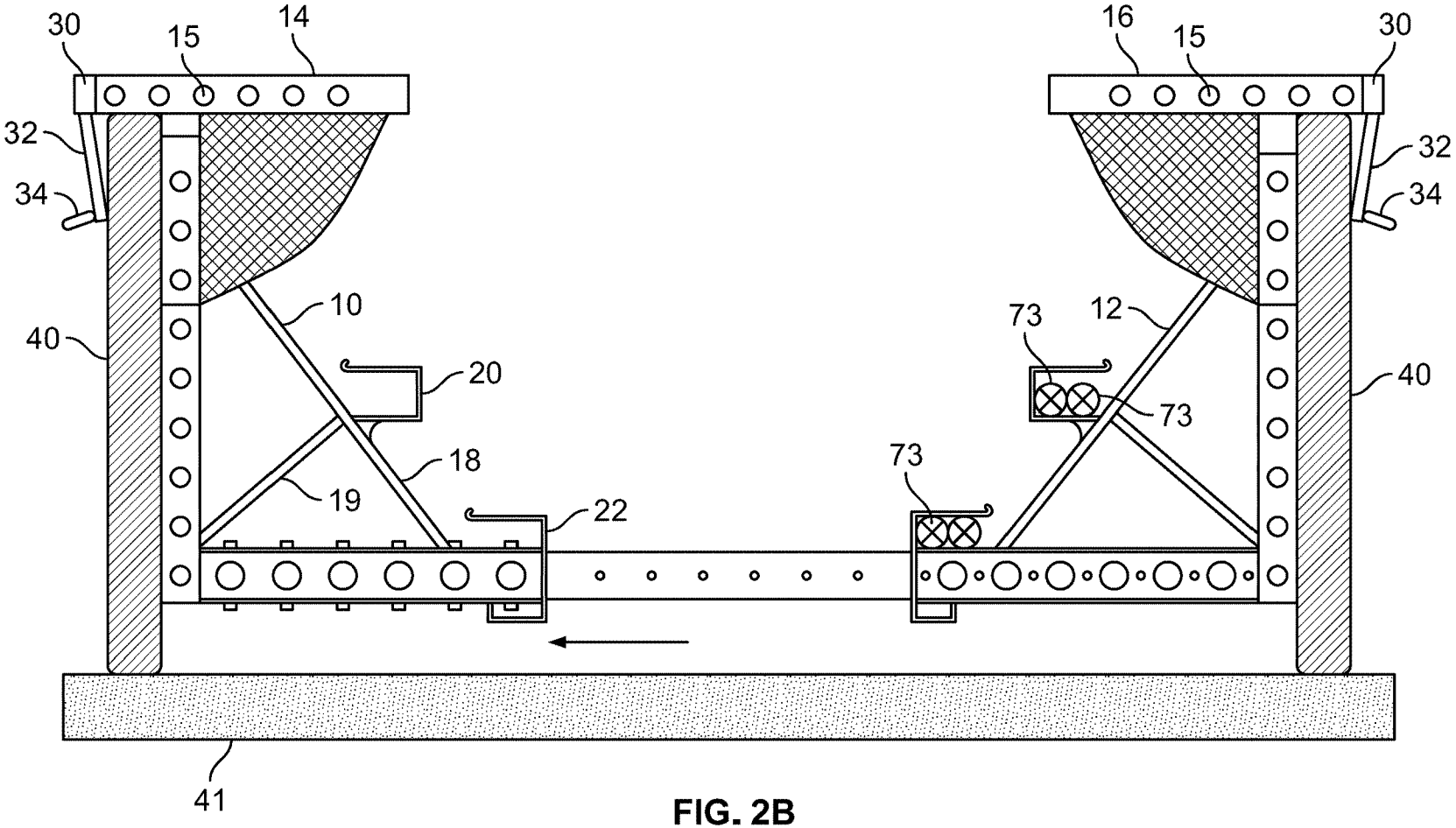
FIG. 2B schematically shows an overall conceptual view of an adjustable concrete form brace after insertion of the top brace element into the lower brace element.

Now referring to FIG. 2B, an overall conceptual side view of an adjustable concrete form brace after insertion of the top brace element into the lower brace element is schematically shown. In operation, the upper brace members 14, 16 will be inserted into the lower brace members 10, 12 so as to engage the forms 40 and hold them in place.

Figure 3:
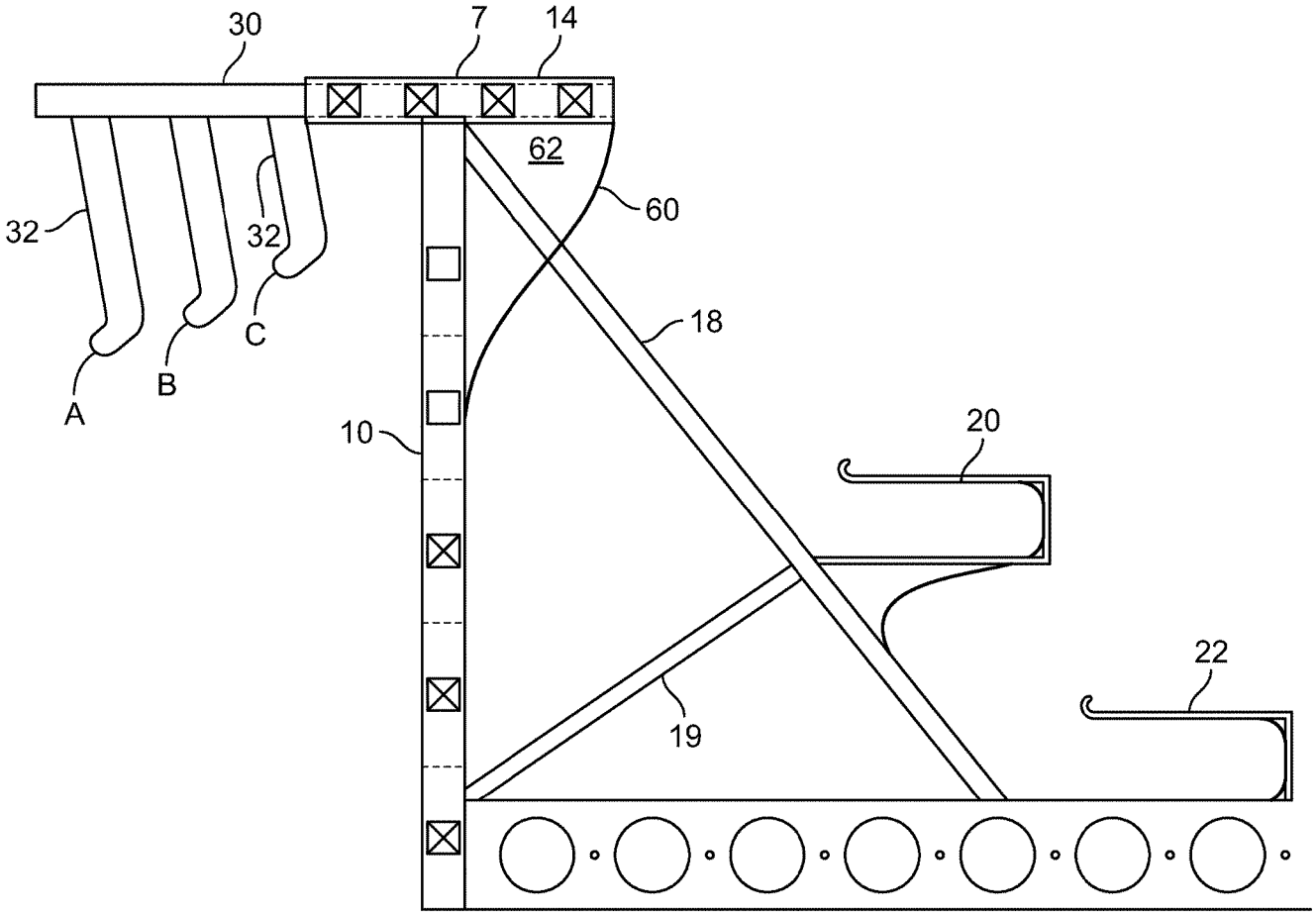
FIG. 3 schematically shows a more detailed side view of a lower brace element having a top brace element inserted.

Referring now to FIG. 3, a more detailed side view of a lower brace element having a top brace element inserted with the attachment member at various positions. A lower support brace 10 is shown with an upper support brace 7 inserted. The upper support brace 7 has a retaining element 30 inserted horizontally into the horizontal portion 14. For purposes of illustration of the expandability of the retaining element 30, the attachment member 32 of the retaining element 30 is shown at positions A, B, and C. Depending upon the width of the form being used, the retaining element 30 may be inserted into the upper horizontal portion 14 at varying widths. For example, it may be inserted to accommodate forms of 2 inches, ½ inches and ¾ of an inch. Other widths may be accommodated depending upon the particular application and the forms used. Each of the first and second or left and right portions of the adjustable concrete brace may be similarly configured.

Figure 4:
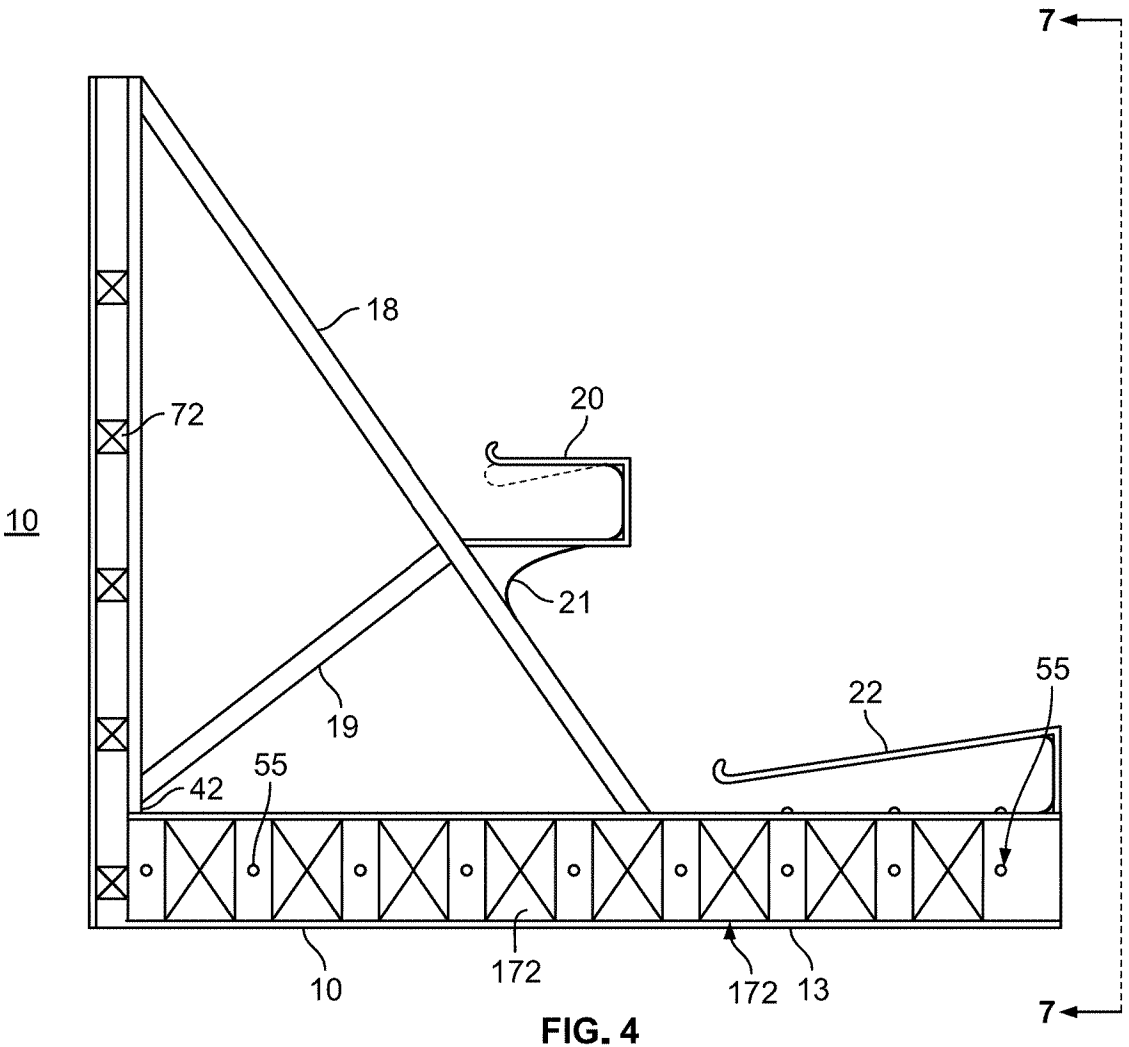
FIG. 4 schematically shows a more detailed side view of a lower brace element.

Referring now to FIG. 4, a more detailed side view of a lower brace element is schematically shown. Here a lower brace member 10 alternatively has rectangular apertures 172 to allow for concrete flow through the brace member. A web 21 is used for supporting each of the saddles 20. Nail holes 55 are provided in the lower horizontal member 13 to be used as needed.

Figure 5:
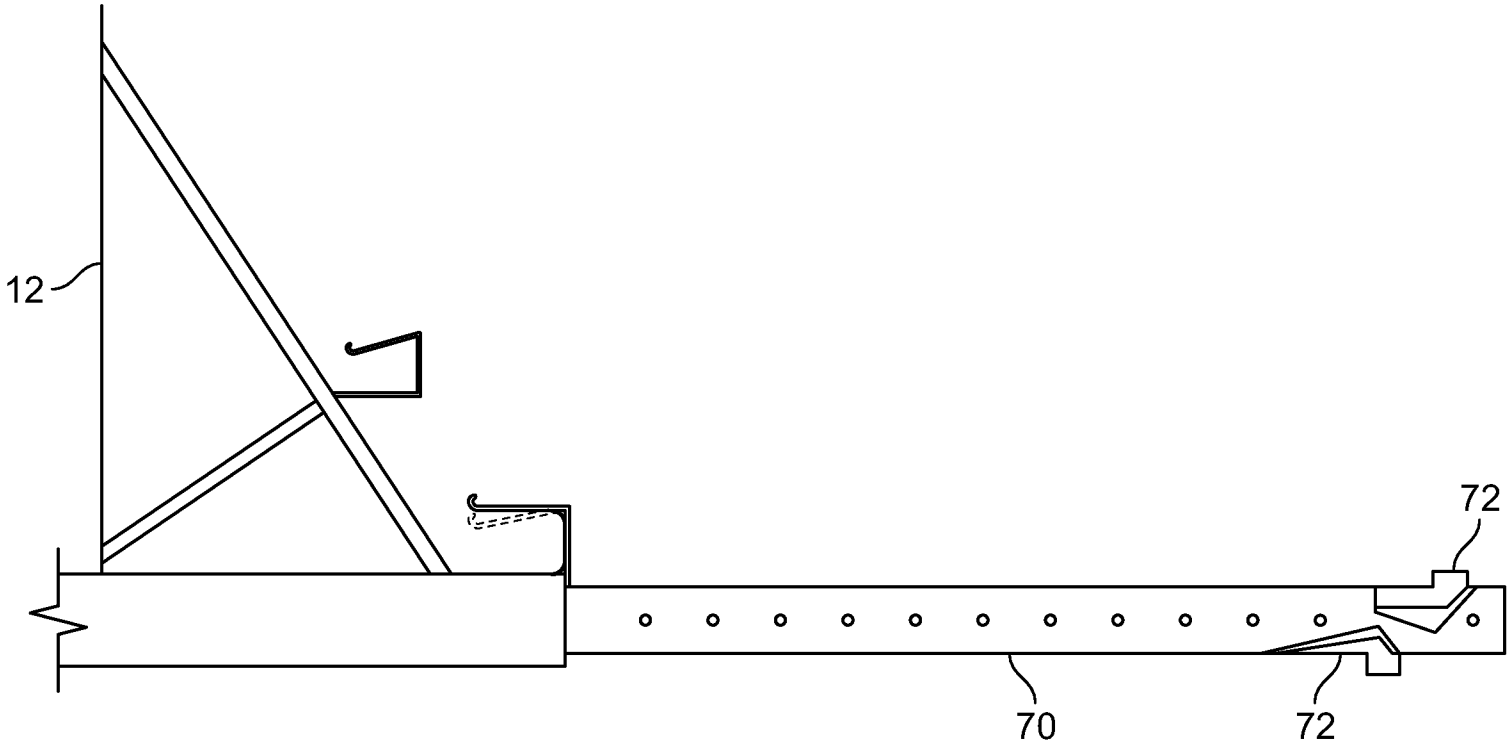
FIG. 5 schematically illustrates an opposite side view of a lower brace element having an extension bar.

Referring now to FIG. 5, an opposite side view of a lower brace element having an extension bar is schematically illustrated. The lower brace element 12 includes an extension member 70 as discussed above. Extension member 70 may advantageously include a spring biased locking mechanism such as snap tabs 72. The snap tabs 72 may be offset on opposing sides of the extension member 70, such as, for example on the top and bottom. Of course, other equivalent configurations and mechanisms may be used such as spring biased detent balls or the like. In operation, the snap tabs 72 engage the detent regions 54 in the opposing lower horizontal brace element.

Figure 6:
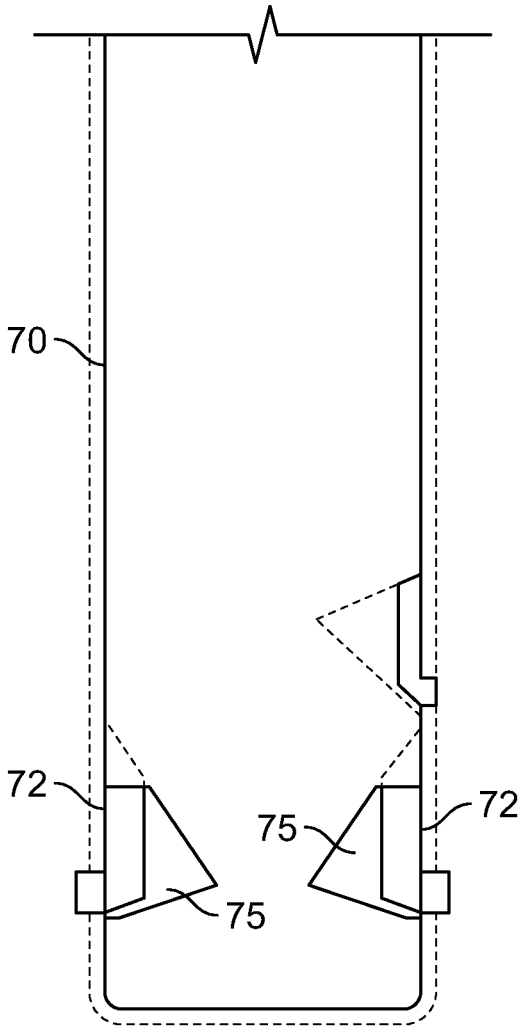
FIG. 6 schematically illustrates a more detailed side view of snap tab elements.

Referring now to FIG. 6, a side view of an alternative embodiment of snap tab element is schematically illustrated. An extension element 70 includes a pair of opposing snap tab elements 72. The snap tab elements are generally located along the same horizontal plane and are cantilevered spring biased components which recede into a recessed area 75 when depressed for insertion into a channel of a lower brace member. As with the components described above with respect to FIG. 6, a selected detent region is reached the components "snap" into place to lock the extension bar at a selected width. Note that in some examples, extension elements may be sized to allow the width of the adjustable form brace five to be 14 inches to 8 feet wide, or, more preferably 14 inches to 6 feet wide for some applications. Also note that here an alternative configuration for the snap tab elements 72 is shown. They may be opposite and parallel from each other, or staggered as shown above with reference to FIG. 2A.

Figure 6A:
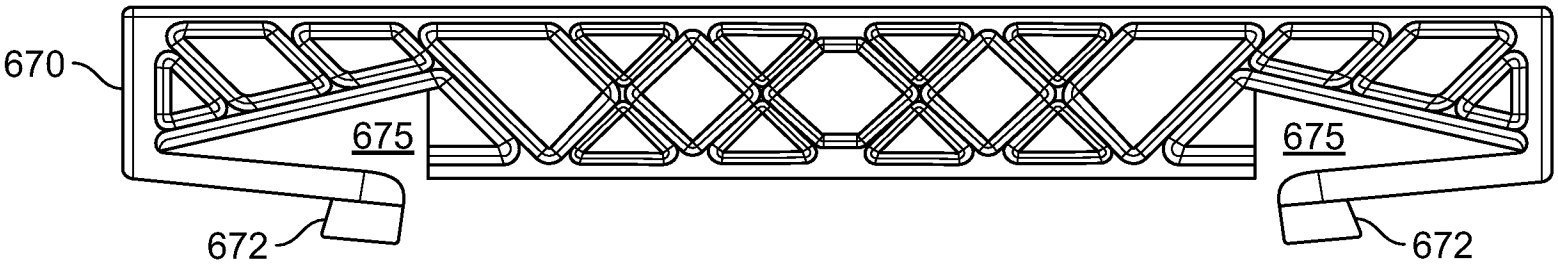
FIG. 6A schematically illustrates a side view of an alternative embodiment of snap tab element.

Referring now to FIG. 6A, a more detailed side view of snap tab elements is schematically illustrated. An extension element 670 includes a pair of opposing snap tab elements 672. The snap tab elements are cantilevered spring biased components which recede into a recessed area 675 when depressed for insertion into a channel of a lower brace member. In a departure from the snap tab element described above with respect to FIG. 6, extension element 670 is intended to be slidably inserted into two opposing form braces. This is described further below with respect to FIG. 9.

Figure 7:
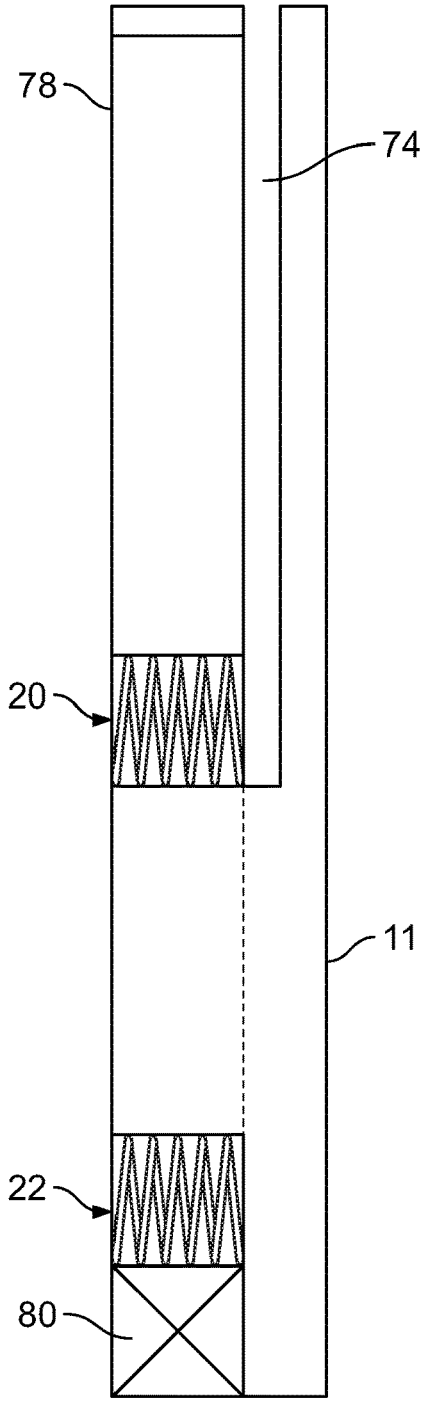
FIG. 7 schematically illustrates a more detailed side view of a lower vertical brace element taken along a view from FIG. 4.

Referring now to FIG. 7, a more detailed side view of a lower brace vertical element is schematically shown as seen from a cutaway view of FIG. 4. The lower brace vertical element 11 includes a web channel 74, first and second saddles 20, 22 and an insertion channel 80. The insertion channel 80 is advantageously size to accept and mate with an extension element. The web channel 74 is sized to receive the width of the web border 60 and web 62 when an upper brace element is inserted into the lower brace element.

Figure 8A:
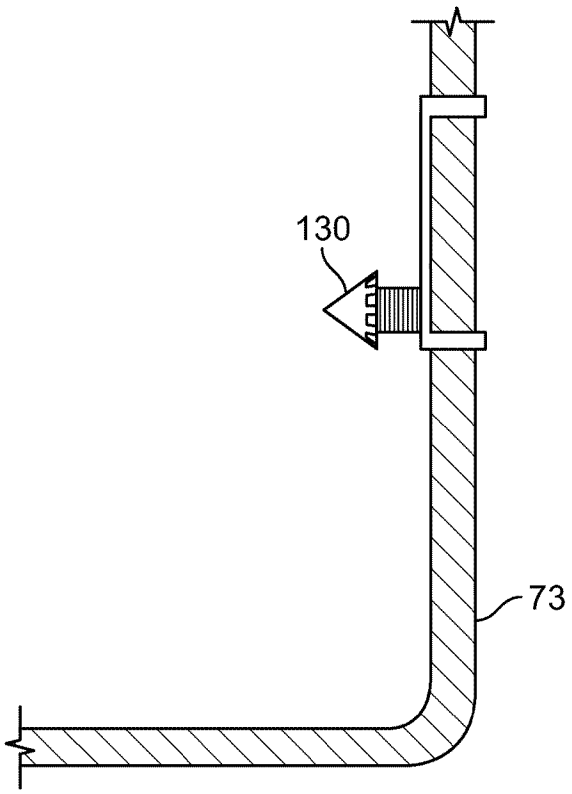
FIG. 8A schematically illustrates a more detailed side view of an adjustable vertical brace as viewed from a cut taken along 8A in FIG. 8.
Figure 8:
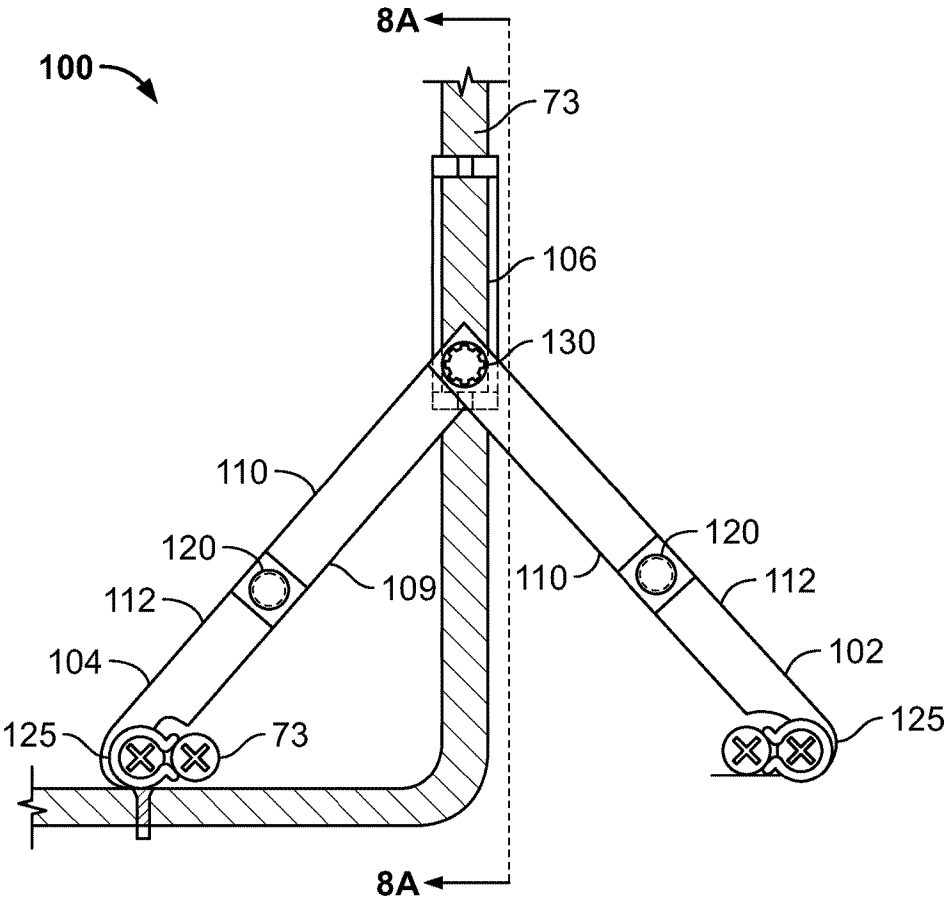
FIG. 8 schematically illustrates a side view of an adjustable vertical brace.

Referring now to FIG. 8, a side view of an adjustable vertical brace is schematically illustrated. An adjustable vertical brace 100 includes a right leg 102, a left leg 104 and a collar 106. The right leg 102 and the left leg 104 are made from at least two extendable components including a top component 110 and a bottom component 112. The extendable components are made in a telescoping configuration with a locking mechanism 120 located about midpoint where the top and bottom components join together. The locking component may be any known locking mechanism such as a screw, nut and bolt configuration, wingnut or the like. The collar 106 is sized to slip over a standard reinforcement bar 73. The collar may be positioned by extension or telescoping of the right and left legs. Each of the right and left legs terminate at one end in a resilient clip 125 which is sized to clip snugly to a standard reinforcement bar 73. The top and includes an aperture through which each leg may be joined with the collar 106 by means of a locking mechanism such as a snap tab 130.

Referring now to FIG. 8A, a more detailed side view of an adjustable vertical brace as viewed from a cut taken along 8A in FIG. 8 is schematically illustrated. This more detailed view shows how the collar 106 is held in place over the reinforcement bar 73. Since the collar 106 is also locked onto the left and right legs of the adjustable vertical brace 100, and the legs are clipped onto horizontal reinforcement bars 73, the adjustable vertical brace 100 operates to hold the vertical reinforcement bar portion in a vertical position during a concrete pour. Depending upon the length of the vertical portion of the reinforcement bar, the adjustable vertical brace may be moved up and down by telescoping the legs in and out thereby sliding the collar 106 up and down the vertical portion of the reinforcement bar as desired. When used, the vertical reinforcement bar 73 may be located between a pair of adjustable concrete braces as described above, generally midway between two concrete braces in accordance with local construction regulations. The reinforcement bar generally comprises a single bar that is configured to form an L-shaped reinforcement bar. Thus, the reinforcement bar is usually alternated with horizontal portion of the bar going left to right or right to left.

Figure 9:
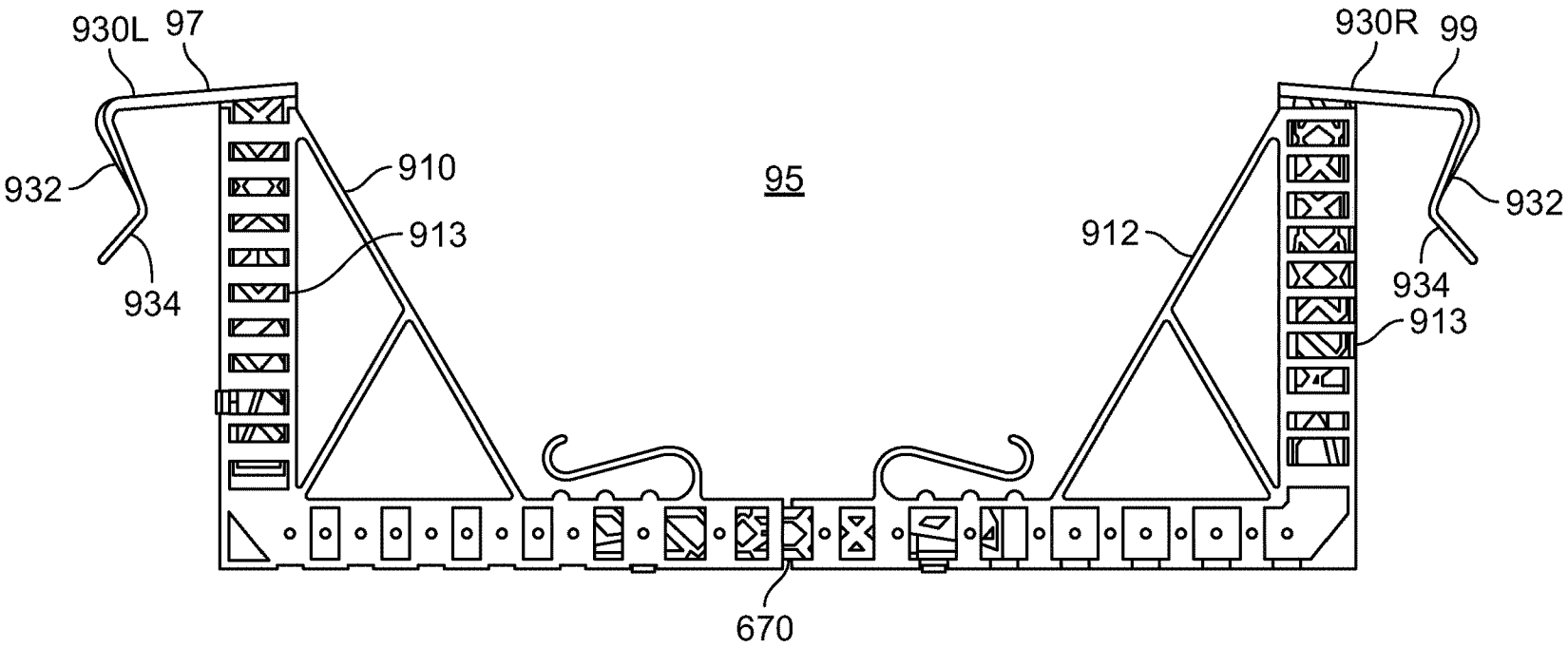
FIG. 9 schematically shows an overall conceptual view of an alternative embodiment of an adjustable concrete form brace.

Referring now to FIG. 9, an overall conceptual view of an alternative embodiment of an adjustable concrete form brace is schematically shown. An adjustable concrete form brace 95 includes a first lower brace element 910 and a second lower brace element 912. The first lower brace element 910 and second lower brace element 912 each include a channel adapted to accept and engage upper brace elements. A first upper brace element 97 and a second upper brace element 99 are configured to be adjustably inserted into the channels within the first and second lower brace elements respectively. The upper brace elements 97, 99 are configured to engage with opposing forms 40 (as shown above). The upper brace elements 97, 99 include left and right form retaining elements 930L, 930R. Note that in a departure from the retaining element 30 described above, the form retaining elements are fixed in the horizontal direction and each includes a downward protruding elongated attachment member 932 having a lip 934. An extension member 670 is installed lengthwise between the lower braces to provide added length when needed. The members are adapted to accommodate a vertical brace, when necessary. In use, the upper brace elements are vertically adjustable, but fixed on top to retain the top of the form. Note that the upper brace elements 930L, 930R are substantially mirror images and thus are constructed in symmetrical fashion.

Figure 10:
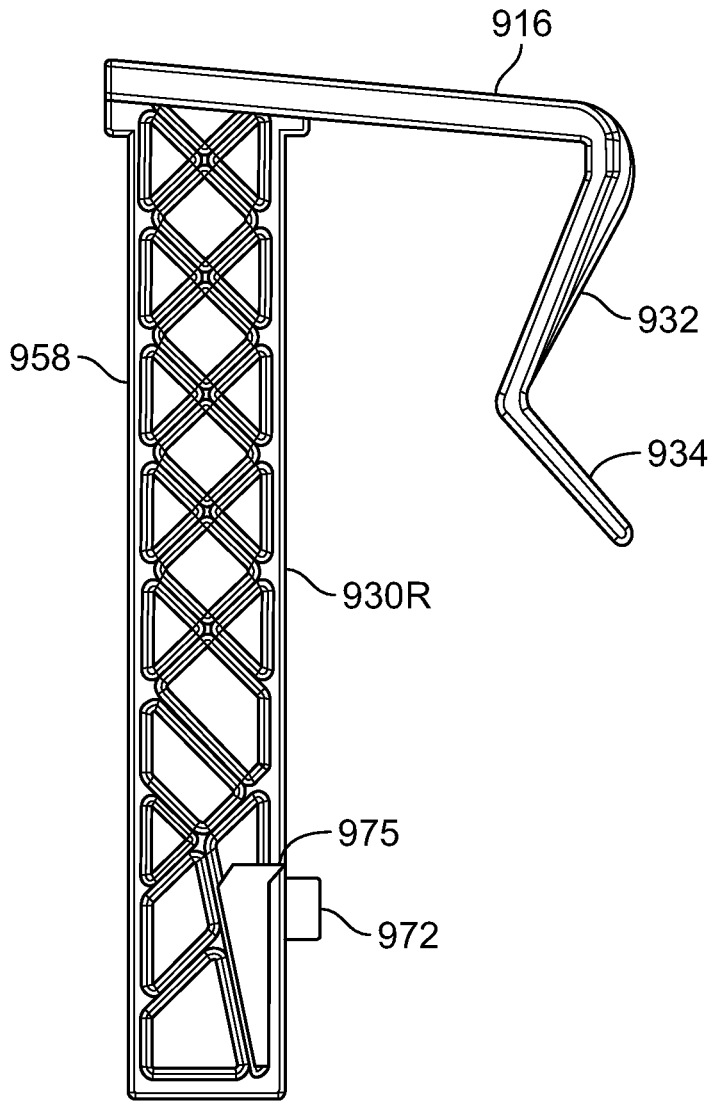
FIG. 10 schematically shows an alternative embodiment of an upper brace element.

Referring now to FIG. 10, an alternative embodiment of an upper brace element is schematically shown. An upper brace element 930, is constructed similarly to the first and second upper brace elements 7, 9 shown above. The upper brace element 930R comprises a horizontal upper element 916. The horizontal element 916 is attached to an upper vertical element 958. The upper vertical element 958 may advantageously be attached perpendicularly to the upper horizontal element. Attached to the upper horizontal element 916 is a form retaining element 930. The form retaining element 930 includes a downward protruding elongated attachment member 932 having a lip 934. The upper brace elements have an outside perimeter sufficiently small to be inserted into a channel inside of the vertical lower brace element 910 or 912 is the case maybe. When lowered, the attachment members 932 will engage forms as described above. The upper brace element also includes at least one snap tab elements 972. The snap tab element is a cantilevered spring biased component which recedes into a recessed area 975 when depressed for insertion into a channel of a lower brace member.

Figure 11:
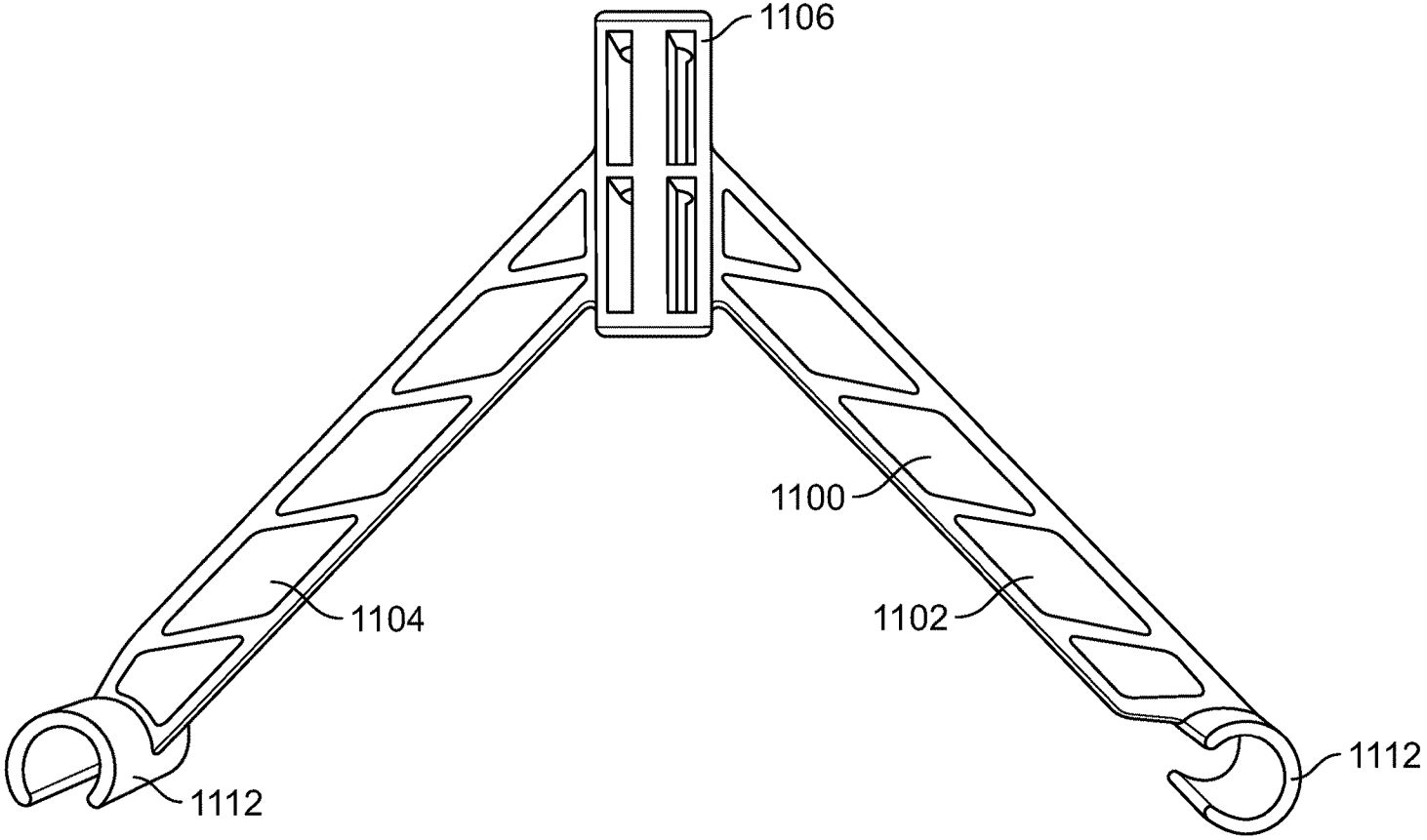
FIG. 11 schematically illustrates a side view of a fixed vertical brace.

Referring now to FIG. 11, a side view of a fixed vertical brace is schematically illustrated. The fixed vertical brace 1100 includes a right leg 1102, a left leg 1104 and a collar 1106. The right leg 1102 and the left leg 1104 are made from at least two elongated components having a first end affixed to the collar 1106. The collar 1106 is sized to slip over a standard reinforcement bar 73 (as shown above in FIG. 8). The collar may be positioned by snapping onto a vertically positioned reinforcement bar. Each of the right and left legs terminate at a bottom end in a resilient clip 1125 which is sized to clip snugly to a standard reinforcement bar 73 running horizontally parallel to the forms.

Having described the configuration of the example embodiments, it will now be useful to the understanding of the invention to describe how the various components are manufactured. The devices can be constructed from any material having properties that make the material satisfactory for use with concrete and provide sufficient strength to support the form side walls against deformation under hydrostatic pressure. For example, the brace components may preferably be fabricated using techniques such as casting or injection molding, and fabricated from a variety of materials, such as metal, plastic or the like.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by different equipment, and devices, and that various modifications, both as to the equipment details and operating procedures, may be accomplished without departing from the true spirit and scope of the present invention.

What is claimed is:

1. An adjustable vertical brace comprising:

a collar having an attachment point;

a right leg having a right top end attached to the attachment point;

a left leg having a left top end attached to the attachment point;

wherein the right leg and the left leg include at least two extendable components including a top component and a bottom component;

wherein each of the extendable components are made in a telescoping configuration with leg locking mechanisms located between the top and bottom components, each leg locking mechanism being adapted to join the top and bottom components together, where the collar is sized to slip over a reinforcement bar and the collar is adapted to be positioned by telescoping of the right and left legs; and wherein each of the right and left legs terminate at one end in a resilient clip which is adapted to clip snugly to a reinforcement bar and the top end includes an aperture through which each leg is joined with the collar by means of a collar locking mechanism located at the attachment point.

2. An adjustable concrete form brace comprises:

a first lower brace element and a second lower brace element, where each lower brace element has a web channel and an insertion channel, and wherein the first lower brace element and the second lower brace element each include a vertical element and a lower brace horizontal element attached at a corner to form a right angle;

a first upper brace element and second upper brace element separately inserted into the insertion channel of one of the lower brace elements, wherein the first upper brace element includes a first upper horizontal element and the second upper brace element includes a second upper horizontal element;

a first saddle attached to the first lower brace member, and a second saddle attached to the second lower brace member, wherein the first saddle and the second saddle are each adapted to retain one or more reinforcement bars;

wherein the second lower brace element also includes an extension member;

wherein the first and second upper horizontal elements each include an inserted horizontally adjustable form retaining element;

an adjustable vertical brace including a right leg, a left leg and a collar; and wherein the right leg and the left leg include at least two extendable components including a top component and a bottom component, wherein each of the extendable components are made in a telescoping configuration with a leg locking mechanism located where the top and bottom components join together, wherein the collar is sized to slip over a reinforcement bar and the collar is adapted to be positioned by telescoping of the right and left legs, and wherein each of the right and left legs terminate at one end in a resilient clip which is adapted to clip snugly to a reinforcement bar and the top end includes an aperture through which each leg is joined with the collar by means of a collar locking mechanism.

3. The adjustable concrete form brace of claim 2 wherein the first and second upper horizontal elements have apertures adapted to allow concrete to flow through the apertures.

4. The adjustable form brace of claim 2 wherein detent areas are located along the surfaces of part of each lower brace for receiving snap tabs, and the extension member includes a plurality of locking snap tabs adapted to mate with the detents so as to allow the combination of the first and second brace members to be adjusted in width.

5. The adjustable form brace of claim 2 wherein each upper support brace has a retaining element inserted into each upper horizontal element and wherein the retaining element is adjustable to accommodate differing widths of forms.

6. The adjustable form brace of claim 2 wherein the extension member comprises a spring biased locking mechanism.

* * * * *